US010302101B2

(12) United States Patent
Schaber

(10) Patent No.: US 10,302,101 B2
(45) Date of Patent: May 28, 2019

(54) HYDRAULIC DRIVE WITH RAPID STROKE AND LOAD STROKE

(71) Applicant: Voith Patent GmbH, Heidenheim (DE)

(72) Inventor: Hubert Schaber, Rutesheim (DE)

(73) Assignee: Voith Patent GmbH, Heidenheim (DE)

( * ) Notice: Subject to any disclaimer, the term of this patent is extended or adjusted under 35 U.S.C. 154(b) by 106 days.

(21) Appl. No.: 14/856,925

(22) Filed: Sep. 17, 2015

(65) Prior Publication Data

US 2016/0084276 A1 Mar. 24, 2016

(30) Foreign Application Priority Data

Sep. 19, 2014 (DE) ..... 10 2014 218 886

(51) Int. Cl.

| | |
|---|---|
| ***F15B 11/08*** | (2006.01) |
| ***B30B 15/16*** | (2006.01) |
| ***B30B 15/28*** | (2006.01) |
| ***B30B 15/34*** | (2006.01) |

(Continued)

(52) U.S. Cl.

CPC ..... *F15B 11/08* (2013.01); *B30B 15/161* (2013.01); *B30B 15/163* (2013.01); *B30B 15/284* (2013.01); *B30B 15/34* (2013.01); *F15B 11/022* (2013.01); *F15B 13/0401* (2013.01); *F15B 2211/2053* (2013.01); *F15B 2211/20515* (2013.01); *F15B 2211/20576* (2013.01); *F15B 2211/212* (2013.01); *F15B 2211/255* (2013.01); *F15B 2211/3058* (2013.01); *F15B 2211/625* (2013.01); *F15B 2211/6313* (2013.01);

(Continued)

(58) Field of Classification Search

CPC ..... B30B 15/161; B30B 15/163; B30B 15/24; F15B 11/022; F15B 13/0401; F15B 11/08

See application file for complete search history.

(56) References Cited

U.S. PATENT DOCUMENTS 5,071,158 A * 12/1991 Yonekawa ..... B60G 17/016 280/5.514

5,852,933 A * 12/1998 Schmidt ..... B30B 15/16 100/269.14

(Continued)

OTHER PUBLICATIONS

German Office Action dated Jun. 2, 2015 for German Application No. 10 2014 218 886.5 (5 pages).

*Primary Examiner* — Abiy Teka

(74) *Attorney, Agent, or Firm* — Taylor IP, P.C.

(57) ABSTRACT

A hydraulic drive including a differential cylinder that has a first pressure chamber and a second pressure chamber and a differential piston, a first hydraulic pump that includes a pump intake and a pump outlet, a directional control valve having a first switching position and a second switching position, a high pressure tank, and an additional hydraulic cylinder that includes an additional pressure chamber hydraulically connected with the pump intake and with the high pressure tank and an additional piston limiting the additional pressure chamber, the differential piston being movably coupled with the additional piston, wherein in the first switching position of the directional control valve the first pressure chamber is hydraulically connected with the second pressure chamber, and in the second switching position of the directional control valve the second pressure chamber is not hydraulically connected with the first pressure chamber.

15 Claims, 2 Drawing Sheets

(51) Int. Cl.
*F15B 11/02* (2006.01)
*F15B 13/04* (2006.01)

(52) U.S. Cl.
CPC ..... *F15B 2211/7054* (2013.01); *F15B 2211/7056* (2013.01); *F15B 2211/775* (2013.01)

(56) References Cited

U.S. PATENT DOCUMENTS

| | | | | |
|---|---|---|---|---|
| 6,584,769 | B1 * | 7/2003 | Bruun | B66F 9/22 60/414 |
| 2012/0067432 | A1 * | 3/2012 | Vigholm | E02F 9/2217 137/14 |
| 2012/0272708 | A1 | 11/2012 | Scheidl et al. | |

* cited by examiner

HYDRAULIC DRIVE WITH RAPID STROKE AND LOAD STROKE

BACKGROUND OF THE INVENTION

1. Field of the Invention

The invention relates to a hydraulic drive having a differential cylinder. The invention moreover relates to a method for operating such a drive.

2. Description of the Related Art

Hydraulic drives are well known from the current state of the art. In practice it is desirable for hydraulic drives, in particular for hydraulic drives for hydraulic presses, to provide a hydraulic drive that on the one hand provides a rapid movement of a drive piston in a so-called rapid stroke or rapid movement with low force, and with which on the other hand a slower action with great force is possible in a so-called load stroke or load movement.

Various drives are known for this purpose from the current state of the art. In one drive with a so-called throttle control, a pump is driven by a motor at constant speed. The control and changeover between rapid stroke and load stroke through control of the volume flow occurs hereby via flow resistances, for example, via valves. A disadvantage of such a drive with throttle control is the low efficiency due to the occurring flow losses.

Drives having a so-called displacement control system are moreover known from the current state of the art. A drive of this type may for example have a variable speed motor that drives two pumps having opposite delivering directions. The two pumps are connected via a hydraulic cylinder in such a way that the pump takes in hydraulic oil from one piston chamber of a hydraulic cylinder and moves hydraulic oil into the other piston chamber. The changeover from rapid stroke to load stroke, or respectively the speed control of the hydraulic drive occurs through changing of the displacement volume of the pump or respectively through a change in the rotational speed of the motor. A disadvantage of such a drive with a displacement control system is that the motor must provide a higher speed for the high speed in the rapid stroke and a high maximum torque for the high force in the load stroke mode. When using a fixed displacement pump, the motor must be designed accordingly because of this high so-called peak performance, and therefore it becomes large, heavy, slow and expensive.

What is needed in the art is a hydraulic drive that can be operated in a rapid stroke and a load stroke mode such that efficiency losses can be avoided and the motor can be produced cost effectively.

SUMMARY OF THE INVENTION

The present invention provides a hydraulic drive that includes a high pressure tank and an additional hydraulic cylinder that has an additional piston limiting the additional pressure chamber, wherein the differential piston is movably coupled with the additional piston. The additional pressure chamber is hydraulically connected with the pump intake and with the high pressure tank. The first pressure chamber is hydraulically connected with the pump outlet, and in the first switching position of the directional control valve the first pressure chamber is hydraulically connected with the second pressure chamber and in the second switching position of the directional control valve the second pressure chamber is not hydraulically connected with the first pressure chamber. In the second switching position the second pressure chamber can be connected with a tank or a low pressure tank. The low pressure tank can have a tank pressure of approximately 2 to 10 bar.

Pump intake and pump outlet are understood to be pump connections of the hydraulic pump. The hydraulic pump may be driven, for example, by a variable speed electric motor, whose direction of rotation is reversible. Consequently, in one direction of rotation of the electric motor hydraulic fluid can be sucked in at the pump intake, whereas hydraulic fluid can be discharged from the hydraulic pump at the pump outlet. When reversing the direction of rotation, hydraulic fluid can be sucked in at the pump outlet, whereby hydraulic fluid can be discharged at the pump intake. For this purpose the hydraulic pump can be designed as a so-called four-quadrant pump. It also conceivable that the hydraulic pump can be designed as a piston or gear pump. Instead of one single hydraulic pump, it is however also conceivable to provide two two-quadrant pumps that deliver in an opposite direction and which are driven by an electric motor whose direction of rotation is also reversible. The two two-quadrant pumps can provide identical delivery volumes. By changing the rotational speed of the electric motor the movement speed of the hydraulic drive can be influenced.

The movable coupling of the differential piston and the additional piston can be mechanical. The differential piston and the additional piston can share a common piston rod. The piston rods of the differential cylinder and the additional hydraulic cylinder may also be, for example, axially aligned with one another and welded together. It is however also conceivable that the piston rods of the differential cylinder and the additional hydraulic cylinder are arranged parallel to one another and are movably coupled with one another by a yoke or a pressing tool that is arranged on the piston rods.

The hydraulic drive according to the present invention can also include a pre-load drive due to the connection of the additional pressure chamber with the high pressure tank. Moreover, due to the interconnection via the directional control valve, a changeover can be achieved from a so-called rapid stroke, having a high speed and comparatively low force to a so-called load stroke having a lower speed and comparatively high force. If, in the first switching position the first pressure chamber is hydraulically connected with the second pressure chamber and if, during operation of the hydraulic drive, hydraulic fluid is moved (pumped) at the pump outlet into the first pressure chamber and hydraulic fluid is moved (sucked) out of the additional pressure chamber at the pump intake, the movably coupled differential pistons and additional pistons can move together in rapid stroke, since the hydraulic fluid that is necessary for filling the first pressure chamber can be provided partially by the hydraulic fluid that is displaced out of the second pressure chamber due to the hydraulic connection of the first and the second pressure chamber. Thus, only the additional hydraulic fluid that cannot already flow out of the second pressure chamber into the first pressure chamber has to be provided by the hydraulic pump at the pump outlet.

If, in the second switching position the first pressure chamber is not hydraulically connected with the second pressure chamber and if, during operation of the hydraulic drive hydraulic fluid is moved (pumped) at the pump outlet into the first pressure chamber and hydraulic fluid is moved (sucked) out of the additional pressure chamber at the pump intake, the movably coupled differential pistons and additional pistons can move together in a so-called load stroke, since the hydraulic fluid that is necessary for filling the first pressure chamber must be provided entirely by the hydraulic pump. At an unchanged pressure provided by the hydraulic pump, the hydraulic pump can now act upon a larger effective surface of the first pressure chamber. The differential piston and the additional piston can operate at greater force and lower speed compared to the rapid stroke.

Since the additional pressure chamber is hydraulically connected with a high pressure tank, cutting shock damping can be provided during the operation of the hydraulic drive by the pre-loading of the additional pressure chamber, in an opposite direction of the effective direction of the drive or respectively in an opposite direction of the pump direction in the load stroke mode. The force resulting from the pressure in the additional pressure chamber can thus, for example, prevent that—in the event of a punch tearing through a metal sheet work piece—the punch makes uncontrolled movements. Cutting shock damping can be adjusted by adjusting the pressure in the high pressure chamber.

A further development of the hydraulic drive provides that the first pressure chamber includes a first hydraulic effective surface, the second pressure chamber includes a second hydraulic effective surface, and the additional pressure chamber includes an additional hydraulic effective surface, wherein a differential surface is consistent with the first and the second effective surfaces of the additional effective surface. The first effective surface is desirably larger hereby than the second effective surface. If the directional control valve is positioned in the first switching position and the pump moves hydraulic fluid into the first pressure chamber (pumps) and moves hydraulic fluid (sucks) out of the additional pressure chamber, the performance of a synchronized speed cylinder can be replicated in the rapid stroke, since then the effective differential surface of the first and the second effective surface that results due to the hydraulic connection of the first and second pressure chamber is consistent with the additional effective surface. Based on the use of a four-quadrant pump or based on two interconnected two-quadrant pumps having identical delivery volumes, and which deliver in opposite directions, a hydraulic drive can be provided wherein the delivery volumes of the hydraulic pump in the rapid stroke mode are adapted to the hydraulic effective surfaces of the pressure chambers. It can thus be achieved that no or almost no hydraulic fluid has to be subsequently sucked from a tank or pressure tank.

If, during the load stroke the delivery volume of the hydraulic pump or respectively the delivery volumes of the hydraulic pumps are no longer adapted to the effective hydraulic surfaces of the differential cylinder and the additional hydraulic cylinder, in other words if more hydraulic fluid is delivered (pumped) into the first pressure chamber than can be moved (sucked) from the additional pressure chamber, a torque assistance of the electric motor driving the hydraulic pump can be achieved via the hydraulic connection with the high pressure tank. The pressure in the additional pressure chamber acts upon the pump intake of the pump, so that the pump can be partially driven as a hydraulic motor, and the electric motor that drives the pump can be sized accordingly smaller.

An additional arrangement of the hydraulic drive provides that the changeover from the rapid stroke to the load stroke can occur when a pressure in the piston chamber is exceeded. A hydraulic control line that hydraulically connects the directional control valve with the first pressure chamber is can be provided for this purpose. In the event of the pressure limit being exceeded, the directional control valve can be moved—against the force of a spring—from the first switching position into the second switching position. When falling below a reset pressure that is below the pressure limit, the directional control valve can then again be moved through spring actuation into the first switching position. If now, for example, a stamping or pressing tool that is driven by the hydraulic drive impinges upon a work piece during the rapid stroke, the pressure increases in the first pressure chamber. If the pressure in the first pressure chamber exceeds the pressure limit, the directional control valve is moved into the second switching position.

A variable speed electric motor may drive the first hydraulic pump. Also, the direction of rotation of the electric motor may be reversible. The rate of movement of the hydraulic drive can be influenced with such an electric motor via the rotational speed. By reversing the direction of rotation of the electric motor a reversal of the direction of delivery of the hydraulic pump or respectively the directions of delivery of the hydraulic pumps can moreover be achieved so that a return stroke of the hydraulic drive can be realized.

The high pressure tank can have a tank pressure of approximately 50 to 150 bar. The low pressure tank then can have a tank pressure that is less than the tank pressure of the high pressure tank. It is for example conceivable that the low pressure tank has a tank pressure of approximately 5 bar.

A hydraulic auxiliary circuit can be provided that includes a feed pump and an auxiliary circuit directional control valve. In a first switching position of the auxiliary circuit directional control valve, the feed pump is hydraulically connected with the high pressure tank.

An additional electric motor may hereby provided which drives the feed pump. In the first switching position of the auxiliary circuit directional control valve, the pressure tank can be filled by the feed pump. The auxiliary circuit directional control valve can include three switching positions, whereby in a second switching position, hydraulic fluid can only drain off into the auxiliary circuit via check valves and pressure relief valves.

In a third switching position of the auxiliary circuit directional control valve, the hydraulic fluid can be directed into the auxiliary circuit for cooling and/or filtering. In the third switching position the system can furthermore be rendered unpressurized.

The hydraulic auxiliary circuit may include a cooler and a filter. In the third switching position of the auxiliary circuit directional control valve, the hydraulic fluid can be directed through the cooler and filter of the auxiliary hydraulic circuit and can consequently be cooled/and or filtered.

A pressure sensor can be provided that is hydraulically connected with the first pressure chamber. The pressure from the first pressure chamber can be used for a stamping force diagnosis. It is moreover conceivable not to design the directional control valve to necessarily be hydraulically actuated whereby the directional control valve is controlled via a hydraulic control line that is connected with the first pressure chamber. Rather, an electric control of the directional control valve can be provided whereby exceeding of the pressure limit can be detected with the pressure sensor that is connected with the first pressure chamber, in order to switch the directional control valve.

A pressure sensor can be provided that is hydraulically connected with the additional pressure chamber. With such a pressure sensor, the pressure in the additional hydraulic cylinder can be monitored, whereby for example monitoring of cutting shock damping that is enabled by the additional pressure chamber can be realized.

A position sensor for measuring the piston position of the two pistons is advantageously provided. If pressure sensors and one position sensor are provided, the hydraulic drive can be pressure-and-position controlled.

An additional embodiment of the hydraulic drive provides that a pressure relief valve can be provided to protect against excess pressure in the first hydraulic pump. A pressure relief valve can be provided to protect against excess pressure in the feed pump.

In a method to operate a hydraulic drive, an additional pressure chamber is supplied in a rapid stroke with hydraulic fluid from the high pressure tank, whereby the hydraulic pump moves hydraulic fluid out of the additional pressure chamber and whereby in the rapid stroke, the first and the second pressure chamber are hydraulically connected, whereby the hydraulic pump moves hydraulic fluid into the first pressure chamber. Due to the hydraulic connection between the first and second pressure chamber, the hydraulic pump only needs to move the differential volume into the first pressure chamber, whereby hydraulic fluid from the second pressure chamber can overflow into the first pressure chamber.

Consequently it can be achieved that the hydraulic pump has to move (pump) comparatively little hydraulic fluid into the first pressure chamber in the rapid stroke, whereby the hydraulic fluid that is moved (sucked) from the additional pressure chamber in regard to its volume is approximately similar to that moved (pumped) into the first pressure chamber.

A further development of the method provides that the additional pressure chamber can be supplied in a load stroke with pressure from the high pressure tank, whereby the hydraulic pump moves hydraulic fluid out of the additional pressure chamber and whereby the first and second pressure chambers are not hydraulically connected in the load stroke, whereby the hydraulic pump moves hydraulic fluid into the first pressure chamber. Since the first and the second pressure chambers are not hydraulically connected in the rapid stroke, the hydraulic pump can now provide the entire volume flow for filling the first pressure chamber, whereby hydraulic fluid can flow from the second pressure chamber into a tank or low pressure tank, unpressurized or almost unpressurized. Consequently, it can be achieved that the hydraulic pump can move (pump) comparatively the same volume of hydraulic fluid into the first pressure chamber at an unchanged pressure provided by the hydraulic pump, in comparison to the rapid stroke. Since the volume of hydraulic fluid moved out (sucked) of the additional pressure chamber is smaller than the hydraulic fluid moved (pumped) into the first pressure chamber, a torque assistance to the hydraulic pump at the pump intake can be realized due to the supply of the additional pressure chamber with pressure from the high pressure chamber. It can thus be achieved that the electric motor driving the hydraulic pump can be sized comparatively small.

Switching from rapid stroke to load stroke can occur when exceeding a pressure limit in the first pressure chamber. If a pressing tool that is mounted on the piston or respectively the piston rod of the hydraulic drive impinges on a work piece during a rapid stroke, the pressure in the first pressure chamber increases. If the pressure limit is exceeded, a changeover from rapid stroke to load stroke can be accomplished, for example, by switching a directional control valve having two switching positions.

After completion of the load stroke, the additional pressure chamber can be supplied with hydraulic fluid from the high pressure tank. After completion of the load stroke, the pressure in the first pressure chamber drops again. Then, a reset of a directional control valve can, for example, occur from its second into its first switching position. The direction of rotation of an electric motor driving the pumps can be reversed, so that hydraulic fluid is moved (pumped) at the pump intake out of the pump and is moved (sucked) at the pump outlet into the pump. Due to the supply of the additional pressure chamber with hydraulic fluid from the high pressure chamber, a braking effect can be provided by the hydraulic pump or respectively the electric motor, so that a non-controlled return stroke of the pistons of the differential cylinders and the additional hydraulic cylinder can be prevented.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one embodiment of the invention and such exemplification is not to be construed as limiting the scope of the invention in any manner.

DETAILED DESCRIPTION OF THE INVENTION

Figure 1:
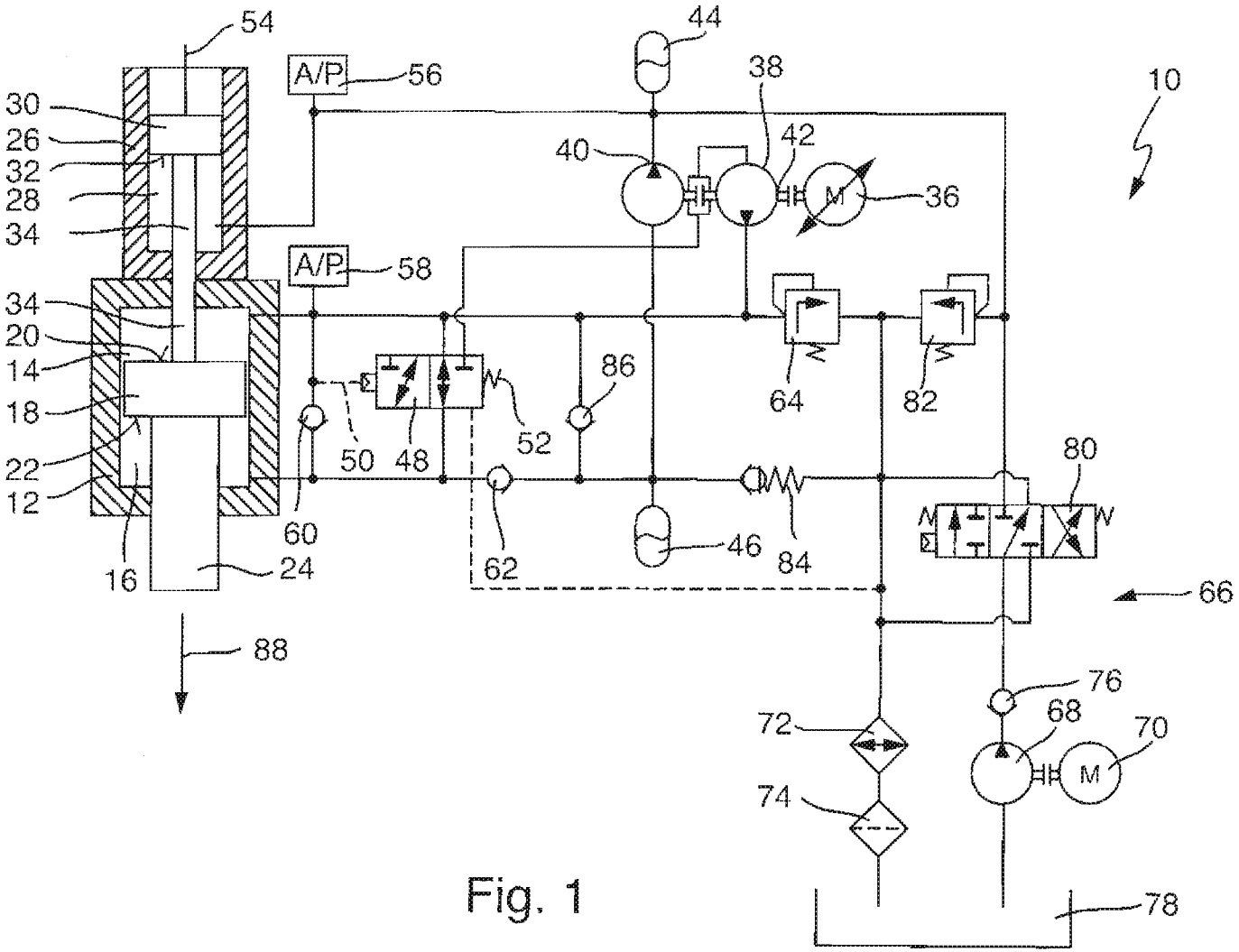
FIG. 1 is a hydraulic circuit diagram that illustrates a first embodiment of a hydraulic drive according to the present invention.

Referring now to FIG. 1, there is shown a hydraulic drive 10 according to the current invention. Drive 10 includes a differential cylinder 12 that includes a first pressure chamber 14, a second pressure chamber 16 and a differential piston 18 that separates the first pressure chamber 14 from second pressure chamber 16. First pressure chamber 14 has a first hydraulic effective surface 20, whereby second pressure chamber 16 has a second hydraulic effective surface 22. First hydraulic effective surface 20 is larger than second hydraulic surface 22. Piston 18 is connected with piston rod 24 on which, for example, a pressing tool that is not illustrated in the drawings can be mounted.

Drive 10 moreover includes an additional hydraulic cylinder 26, having an additional pressure chamber 28 and an additional piston 30 which limits additional pressure chamber 28. Additional pressure chamber 28 comprises a hydraulic additional effective surface 32. Hydraulic additional effective surface 32 can be as large as a differential surface of the first hydraulic effective surface 20 and the second hydraulic effective surface 22, so that the following may apply:

$$A_{32}=A_{20}-A_{22}.$$

Additional piston 30 can be mechanically movably coupled with differential piston 18 by a common piston rod 34.

Drive 10 further includes an adjustable speed electric motor 36 whose direction of rotation can be reversible. Electric motor 36 drives a hydraulic pump 38 which includes a pump intake 40 and a pump outlet 42. Hydraulic pump 38 can be designed as a four-quadrant pump. It can however also be replaced by two two-quadrant pumps that deliver in an opposite direction and provide identical delivery volumes.

Drive 10 includes a high pressure tank 44 and a low pressure tank 46. High pressure tank 44 may have a tank pressure of approximately 100 bar, whereas low pressure tank 44 may have a tank pressure of approximately 5 bar. Furthermore, drive 10 includes a directional control valve 48 having two switching positions. Directional valve 48 features a hydraulic control line 50 that is hydraulically connected with first pressure chamber 14 and can be moved from a first switching position illustrated in FIG. 1 against the force of a spring 52 into a second switching position.

A directional control valve 48 or position sensor 54 can be arranged on additional piston 30, or respectively in the region of additional piston 30 with which a current piston position of additional piston 30 or respectively of differential piston 18 can be detected. Furthermore, a pressure sensor 56 can be provided that is hydraulically connected with additional pressure chamber 28 for measuring the pressure in additional pressure chamber 28. Furthermore, a pressure sensor 58 can be provided for the purpose of measuring the pressure in first pressure chamber 14 and which is connected hydraulically with first pressure chamber 14.

A check valve 60 can be arranged between first pressure chamber 14 and second pressure chamber 16 for switching changeover compensation of directional control valve 48. An additional check valve 62 can furthermore be arranged for switching changeover compensation between second pressure chamber 16 and low pressure tank 46. Furthermore, a pressure relief valve 64 can be provided for overpressure protection of hydraulic pump 38.

Hydraulic drive 10 can include an auxiliary hydraulic circuit 66 that includes a feed pump 68 which in turn is driven by an electric motor 70. Auxiliary circuit 66 can moreover include a cooler 72, a filter 74, a check valve 76, and a tank 78. Auxiliary circuit 66 furthermore can have an auxiliary circuit directional control valve 80 that has three switching positions. In a first switching position, to the left in FIG. 1, feeding pump 68 is hydraulically connected with high pressure tank 44. In a second switching position, in the center in FIG. 1, hydraulic fluid can only drain off via a pressure relief valve 82 that is intended for pressure relief of feed pump 68, pressure relief valve 62, as well as via a pre-tensioned valve 84 into auxiliary circuit 66, in other words through cooler 72 and filter 74. In a third switching position of auxiliary circuit direction control valve 80, to the right in FIG. 1, hydraulic fluid can be directed for cooling and/or filtering into auxiliary circuit 66.

Hydraulic circuit 10 lastly may also include a check valve 86, which is provided to prevent cavitation during operation, in other words, it is provided for the case that the delivery volume of pump 38 is not adapted to the volumes of respective pressure chambers 14, 16, 28.

In FIG. 1, pump intake 40, as well as high pressure tank 44 are hydraulically connected with additional pressure chamber 28. First pressure chamber 14 is furthermore hydraulically connected with pump outlet 42. In one switching position of directional control valve 48 illustrated on the right in FIG. 1, directional control valve 48 is shifted through the spring force of spring 52. In the first switching position, first pressure chamber 14 is hydraulically connected with second pressure chamber 48. If a pressure limit that is adjustable via the spring force of spring 52 is exceed, directional control valve 48 can be switched into a second switching position that is illustrated right in FIG. 1, whereby first pressure chamber 14 is not hydraulically connected with second pressure chamber 16 in the second switching position. Rather, second pressure chamber 16 is then hydraulically connected with low pressure chamber 46.

Hydraulic drive 10 can operate as follows: during operation of hydraulic drive 10, high pressure tank 44 can be charged in the first switching position of auxiliary circuit directional control valve 80 by feed pump 68 to a tank pressure of approximately 100 bar. Due to the hydraulic connection of high pressure tank 44 with additional pressure chamber 28, the same acts as an hydraulic spring, in other words the hydraulic drive 10 is pre-tensioned upward, in other words in an opposite direction of an arrow 88, as shown in FIG. 1.

In one rotational direction of electric motor 36, hydraulic pump 38 moves (pumps) hydraulic fluid at pump outlet 42 into first pressure chamber 14, whereas hydraulic pump 38 moves (pumps) hydraulic fluid out of additional pressure chamber 28 at pump intake 40. If directional control valve 48 is in its first switching position first pressure chamber 14 is connected with second pressure chamber 16. If differential piston 18 and additional piston 30 that are movably coupled via common piston rod 34 are moved downward in the direction of arrow 88, hydraulic fluid can flow from second pressure chamber 16 via directional control valve 48 into first pressure chamber 14, due to the hydraulic connection of first and second pressure chambers 14, 16.

Figure 2:
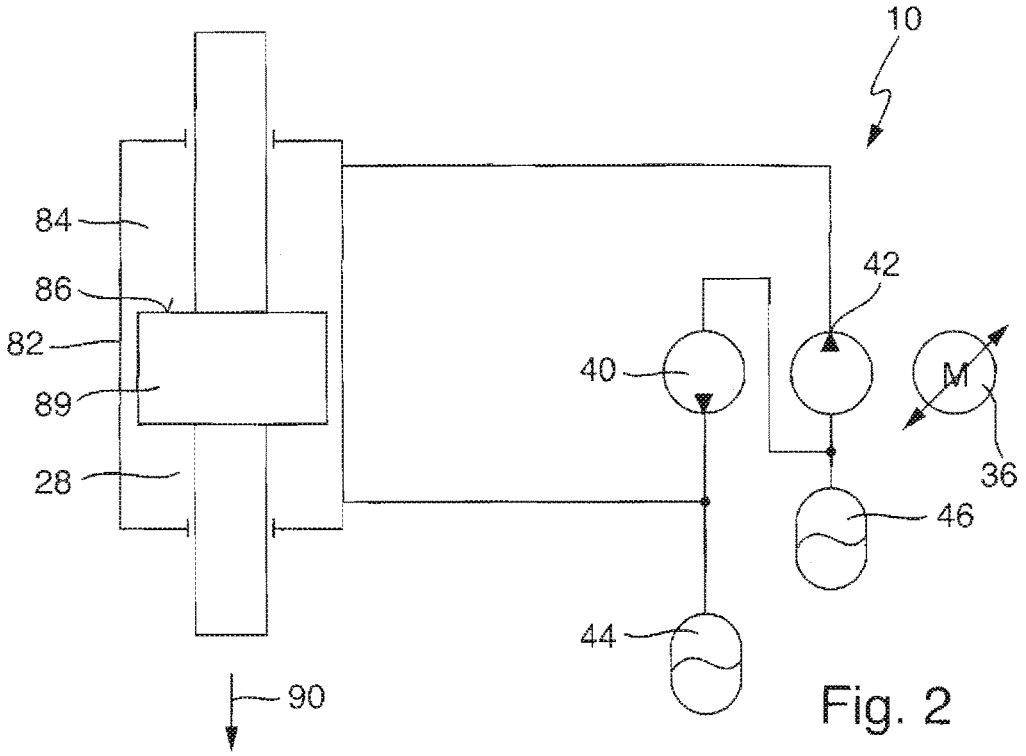
FIG. 2 is a substitute circuit diagram that illustrates the hydraulic drive according to the present invention, as shown in FIG. 1, in a rapid stroke.

Only the hydraulic fluid for filling first pressure chamber 14 which cannot already overflow from second pressure chamber 16 must consequently be provided by the hydraulic pump 38 at pump outlet 42. Since hydraulic effective surface 32 is as large as the differential surface of first hydraulic effective surface 20 and second hydraulic effective surface 22, a substitute circuit diagram as illustrated in FIG. 2 can be realized. Hydraulic drive 10 acts like a synchronized speed cylinder 82 that can include additional pressure chamber 28 and a resulting pressure chamber 84.

A hydraulic effective surface 86 of resulting pressure chamber 84 is consistent with the differential surface of first hydraulic effective surface 20 and second hydraulic effective surface 22. Piston 89, illustrated in FIG. 2, can be moved in a rapid stroke in the direction of arrow 90.

It is important that FIG. 2 represents a substitute circuit diagram of drive 10 according to FIG. 1, whereby the direction of movement of the drive in FIG. 2 is not consistent with the direction of movement of the drive in FIG. 1. If, as explained above, hydraulic fluid can flow from second pressure chamber 16 into first pressure chamber 14 via directional control flow valve 48, movably coupled pistons 18, 30 can be moved downward in the direction of arrow 88 in a so-called rapid stroke at comparatively low force and high speed. The movement speed is adjustable via the rotational speed of electric motor 36.

If a stamping or pressing tool which is not illustrated in FIG. 1 and that is arranged on piston rod 24 impinges upon an obstacle, for example, a metal sheet work piece, the pressure increases in first pressure chamber 14. If the pressure in first pressure chamber 14 increases to above the pressure limit or switching pressure of directional control valve 48 which is preset by spring 52 and which is fed back via control line 50 to directional control valve 48, then directional control valve 48 is moved from the first switching position into the second switching position—against the spring force of spring 52. Second pressure chamber 16 is now hydraulically connected with low pressure tank 46.

Figure 3:
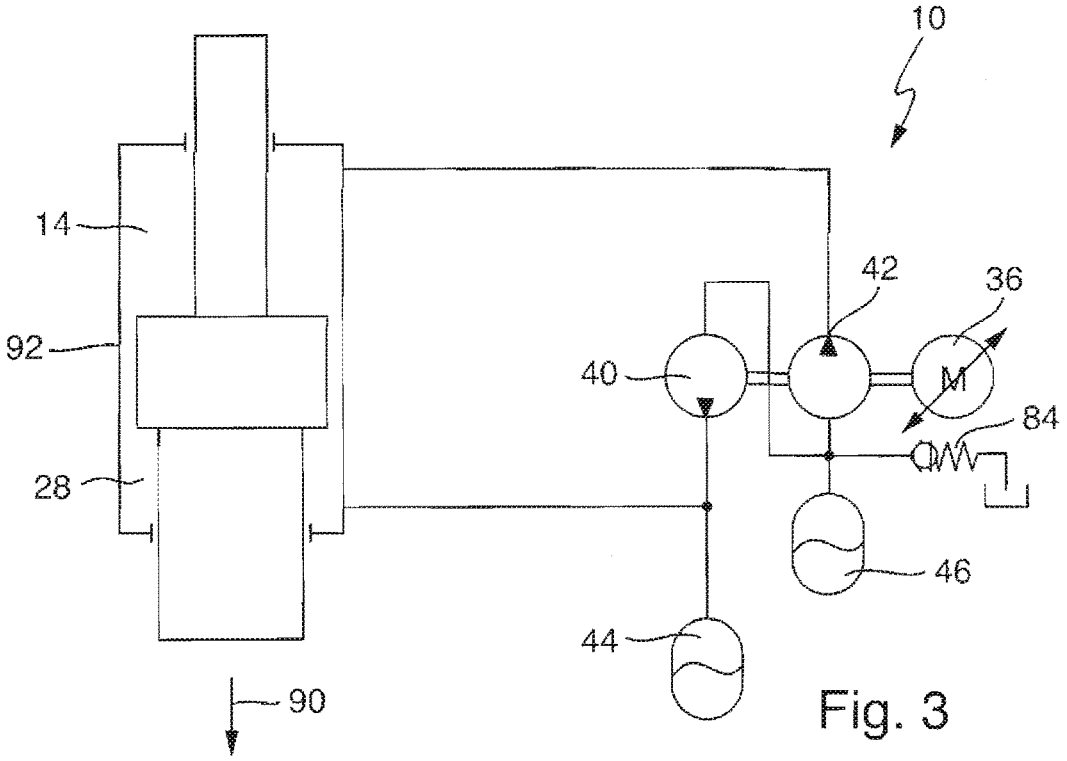
FIG. 3 is a substitute circuit diagram that illustrates the hydraulic drive according to the present invention, as shown in FIG. 1, in a load stroke.

The behavior of hydraulic drive 10 in the second switching position of directional control valve 48 can also be illustrated by a substitute circuit diagram that is illustrated in FIG. 3. Since the hydraulic fluid can no longer flow from second pressure chamber 16 into first pressure chamber 14, the entire hydraulic fluid that is necessary for filling first pressure chamber 14 must be provided by hydraulic pump 38. At an unchanged pump pressure of hydraulic pump 38, hydraulic pump 38 now no longer delivers onto the differential surface of first hydraulic effective surface 20 and of second hydraulic effective surface 22, but rather only onto first hydraulic effective surface 20. Hydraulic drive 10 thus acts in the second switching position of directional control valve 48 like a differential cylinder 92, as shown in FIG. 3.

It is important that also in FIG. 3 a substitute circuit diagram of drive 10 is illustrated, whereby the operating direction of drive 10 in FIG. 3 is not consistent with the operating direction of the drive in FIG. 1. If hydraulic pump 38 described above moves (pumps) hydraulic fluid at pump outlet 42 into first pressure chamber 14 and moves (sucks) hydraulic fluid at pump intake 40 out of additional pressure chamber 28, movably coupled pistons 18, 30 can be moved in a so-called load stroke downward in the direction of arrow 88 at comparatively great force and low speed.

Since now the delivery volume of hydraulic pump 38 at pump intake 40 and at pump outlet 42 is no longer adapted to the surface ratio of hydraulic effective surfaces 20, 32 and—as shown in FIG. 3—hydraulic drive 10 acts like a differential cylinder 92, additional hydraulic fluid for filling additional pressure chamber 28 must be provided by high pressure tank 44. Since high pressure tank 44 has a tank pressure of approximately 100 bar, a pressure acts upon pump intake 40 in rapid stroke, whereby hydraulic pump 38 can thus be partially operated as a motor. Due to the pressure at pump intake 40, torque assistance can be achieved, whereby in turn electric motor 36 can be sized smaller.

Since additional pressure chamber 28 is hydraulically connected with a high pressure tank 44, cutting shock damping can be provided during the operation of hydraulic drive 10 by the pre-tensioning of additional pressure chamber 28, in an opposite direction of the effective direction of drive 10 in the load stroke mode. The force resulting from the pressure in additional pressure chamber 28 can thus, for example, prevent that—in the event of a punch tearing through a metal sheet work piece—the punch makes an uncontrolled movement. Cutting shock damping can be adjusted by adjusting the pressure in high pressure chamber 44.

After completion of the load stroke, the pressure in first pressure chamber 14 can drop below a reset pressure which is below the pressure limit of directional control valve 48. Directional control valve 48 can again be returned into the first switching position through the spring force of spring 52.

If the rotational direction of electric motor 26 and thereby also the delivery direction of hydraulic pump 38 is reversed, and hydraulic pump 38 therefore moves (pumps) hydraulic fluid at the pump intake out of hydraulic pump 38, and at pump outlet 42 moves (sucks) hydraulic fluid into hydraulic pump 38, movably coupled pistons 18, 30 can again be moved upward in a return stroke, in the opposite direction to that indicated by arrow 88.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A hydraulic drive, comprising:
- a differential cylinder, including:
  - a first pressure chamber and a second pressure chamber; and
  - a differential piston that separates the first pressure chamber from the second pressure chamber;
- a first hydraulic pump, including:
  - a pump intake and a pump outlet;
- a directional control valve having a first switching position and a second switching position;
- a low pressure tank;
- a high pressure tank; and
- an additional hydraulic cylinder, including:
  - an additional pressure chamber hydraulically connected with said pump intake and with said high pressure tank; and
  - an additional piston limiting the additional pressure chamber, said differential piston being movably coupled with said additional piston by a common piston rod such that said differential piston and said additional piston are coaxial, wherein said first pressure chamber is hydraulically connected with said pump outlet, and further wherein in the first switching position of said directional control valve said first pressure chamber is hydraulically connected with said second pressure chamber, and in the second switching position of said directional control valve said second pressure chamber is not hydraulically connected with said first pressure chamber and is instead hydraulically connected with the low pressure tank.

2. The hydraulic drive according to claim 1, wherein said first pressure chamber includes a first hydraulic effective surface, said second pressure chamber includes a second hydraulic effective surface, and said additional pressure chamber includes an additional hydraulic effective surface, whereby a differential surface is consistent with the first hydraulic effective surface and the second hydraulic effective surface of said additional hydraulic effective surface.

3. The hydraulic drive according to claim 1, wherein said directional control valve is designed such that it can be switched when a pressure limit is exceeded in said first pressure chamber.

4. The hydraulic drive according to claim 1, further including a variable speed electric motor that drives said first hydraulic pump.

5. The hydraulic drive according to claim 1, wherein said high pressure tank has a tank pressure of 50 to 150 bar.

6. The hydraulic drive according to claim 1, wherein said high pressure tank has a tank pressure of 100 bar.

7. The hydraulic drive according to claim 1, further including a hydraulic auxiliary circuit that includes a feed pump and an auxiliary circuit directional control valve, wherein in a first switching position of the auxiliary circuit directional control valve, the feed pump is hydraulically connected with said high pressure tank.

8. The hydraulic drive according to claim 7, wherein said hydraulic auxiliary circuit further includes a cooler and a filter.

9. The hydraulic drive according to claim 1, further including a pressure sensor that is hydraulically connected with said first pressure chamber.

10. The hydraulic drive according to claim 1, further including a pressure sensor that is hydraulically connected with said additional pressure chamber.

11. The hydraulic drive according to claim 1, further including a position sensor for measuring a position of at least one of said differential piston and said additional piston.

12. The hydraulic drive according to claim 1, further including a pressure relief valve to protect against an excess pressure in said first hydraulic pump.

13. A method for operating a hydraulic drive having a hydraulic fluid therein and including a differential cylinder that includes a first pressure chamber, a second pressure chamber and a differential piston that separates the first pressure chamber from the second pressure chamber, a low pressure tank, a high pressure tank, and an additional hydraulic cylinder that includes an additional pressure chamber and an additional piston which limits the additional pressure chamber, wherein said differential piston is movably coupled with said additional piston by a common piston rod such that said differential piston and said additional piston are coaxial, the method comprising the steps of:

moving the hydraulic fluid to said additional pressure chamber from said high pressure tank in a rapid stroke;

moving the hydraulic fluid out of said additional pressure chamber via said hydraulic pump;

moving the hydraulic fluid into said first pressure chamber via said hydraulic pump, wherein in the rapid stroke the first pressure chamber and the second pressure chamber are hydraulically connected; and moving the hydraulic fluid from said high pressure tank to said additional pressure chamber in a load stroke, in which the first pressure chamber and the second pressure chamber are not hydraulically connected and instead the second pressure chamber is hydraulically connected to the low pressure tank.

14. The method according to claim 13, wherein switching from the rapid stroke to the load stroke occurs when exceeding a pressure limit in first pressure chamber.

15. The method according to claim 14, wherein after a completion of the load stroke, said additional pressure chamber is supplied with hydraulic fluid from said high pressure tank.

* * * * *